US007188612B2

(12) United States Patent
Hattori

(10) Patent No.: US 7,188,612 B2
(45) Date of Patent: Mar. 13, 2007

(54) CONTROL SYSTEM FOR INTERNAL COMBUSTION ENGINE

(75) Inventor: Shogo Hattori, Kawachi-gun (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 10/552,746

(22) PCT Filed: Apr. 19, 2004

(86) PCT No.: PCT/JP2004/005568

§ 371 (c)(1),
(2), (4) Date: Oct. 11, 2005

(87) PCT Pub. No.: WO2004/094799

PCT Pub. Date: Nov. 4, 2004

(65) Prior Publication Data

US 2006/0180126 A1 Aug. 17, 2006

(30) Foreign Application Priority Data

Apr. 22, 2003 (JP) ..... 2003-116814

(51) Int. Cl.
*F02M 69/48* (2006.01)

(52) U.S. Cl. ..... 123/494; 73/118.2

(58) Field of Classification Search ..... 123/494; 73/118.2

See application file for complete search history.

(56) References Cited

U.S. PATENT DOCUMENTS 5,432,701 A 7/1995 Mayer et al.
2002/0073971 A1* 6/2002 Katayama ..... 123/478

FOREIGN PATENT DOCUMENTS

| | | |
|---|---|---|
| JP | 58-27839 | 2/1983 |
| JP | 4-15388 | 3/1992 |
| JP | 5-72074 | 3/1993 |
| JP | 5-157036 | 6/1993 |

OTHER PUBLICATIONS

Japanese Office Action with English translation of the Office Action, Application No. 2003-116814, Nov. 28, 2006, a total of 6 sheets.

* cited by examiner

*Primary Examiner*—Erick Solis
(74) *Attorney, Agent, or Firm*—Squire, Sanders & Dempsey L.L.P.

(57) ABSTRACT

An engine control system (1) measures an amount of air sucked by an engine (2) based on the output of an air flow meter (14) provided in an air intake passage (4), on the downstream side of a throttle valve (12), calculates an injection amount of fuel based on the air amount measured, and injects the fuel from an injector (5). The air flow meter (14) is installed at a position on the downstream side of the throttle valve (12), away from the valve (12) by a predetermined distance corresponding to twice to four times the diameter of the air intake passage (4).

2 Claims, 5 Drawing Sheets

CONTROL SYSTEM FOR INTERNAL COMBUSTION ENGINE

TECHNICAL FIELD

The present invention relates to a control system that controls the injection amount and the like of fuel supplied to an internal combustion engine.

Priority is claimed on Japanese Patent Application No. 2003-116814, filed Apr. 22, 2003, the content of which is incorporated herein by reference.

BACKGROUND ART

There are conventional methods for controlling combustion of an internal combustion engine in a vehicle and the like by controlling the spray amount of the fuel so as to match the amount of air sucked from the atmosphere, igniting a mixture of air and fuel in accordance with the angle of rotation of the crank shaft, and injecting it (e.g., see Japan Examined Patent Application, Second Publication No. H04-15388).

The abovementioned document discloses a technique for controlling fuel injection. Specifically, an air flow sensor is used for controlling injection of fuel to a multi-cylinder engine, and is provided in an air intake passage between a throttle valve and an electromagnetic injection valve. A control circuit calculates a basic injection amount from the average flow of inlet air which is measured by the air flow sensor, and the fuel is injected based on this basic injection amount. While the engine cylinder which inlets air changes sequentially in each cycle, fluctuation in the air inlet flow arising at this time is treated as deviation from the average flow of inlet air, and a deviation signal which corresponds to this deviation is directly input to a voltage circuit of the electromagnetic injection valve. More fuel is injected when the deviation signal is large, and less fuel is injected when the deviation is small. The basic injection amount is calculated by compensation using an air inlet temperature sensor which measures the temperature of inlet air, and a cooling water temperature sensor which measures the temperature of cooling water in the engine.

To increase the combustion efficiency and responsiveness, the amount of air actually sucked by the internal combustion engine should be measured in each case, and the optimal amount of fuel determined accordingly. However, when measuring the air flow near the throttle valve, disruption of the air stream caused by opening and closing the throttle valve makes it impossible to accurately measure the flow of air. On the other hand, since the air flow changes little at positions away from the throttle valve, it is difficult to measure changes in the air flow caused by the inlet stroke. In this case, the start and end of air suction must be confirmed by combined use of a sensor for measuring the angle of rotation of another crank shaft, a sensor for measuring the angle of rotation of the cam, and the like. This leads to problems in that, when the number of sensors required to control the injection of fuel increases, processing becomes accordingly complex and the load of the control circuit increases.

The present invention has been realized in order to solve the problems mentioned above by providing a control system for internal combustion engine which has a simple constitution and can inject the required amount of fuel at an appropriate timing.

DISCLOSURE OF INVENTION

The present invention provides a control system for internal combustion engine having a throttle valve in an air intake passage, and includes a sensor which is installed downstream from the throttle valve and measures an amount of air sucked by the internal combustion engine, a control device which calculates an injection amount of fuel based on the amount of air measured by the sensor, and an injector for fuel injection which injects fuel corresponding to the injection amount calculated by the control device. A distance between an installation position of the throttle valve and an installation position of the sensor is set at twice to four times a diameter of the air intake passage.

According to this control system for internal combustion engine, the amount of air flowing in the air intake passage is measured at a predetermined distance downstream from the throttle valve. This distance is twice to four times the diameter of the air intake passage. Since this range is one in which air flows stably in the air intake passage, the sensor installed within this range can accurately measure increase in the flow of air in the air intake passage which accompanies suction. The result measured by the sensor is used by the control device in calculating the amount of fuel to be injected, and the fuel is injected by the injector in accordance with the injection amount calculated.

In the control system for internal combustion engine of this invention, the distance between the installation position of the throttle valve and the installation position of the sensor should preferably be between 44 mm and 66 mm.

According to this control system for internal combustion engine, the amount of air flowing in the air intake passage is measured by the sensor which is installed at a distance of between 44 mm and 66 mm downstream from the throttle valve. This enables large air amount changes to be measured during suction.

BEST MODE FOR CARRYING OUT THE INVENTION

Figure 1:
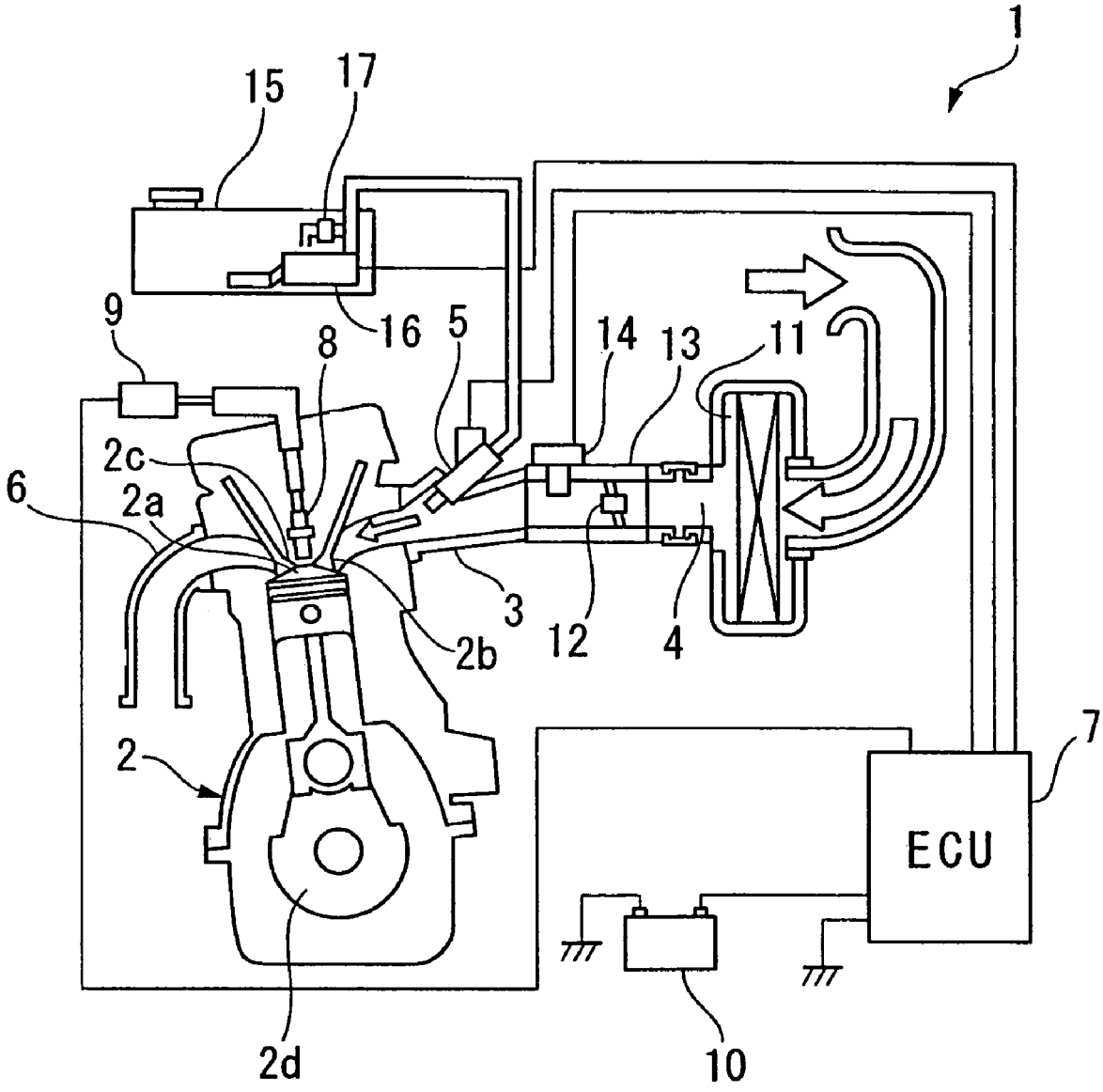
FIG. 1 is a schematic diagram of a control system for engine according to an embodiment of this invention.
Figure 2:
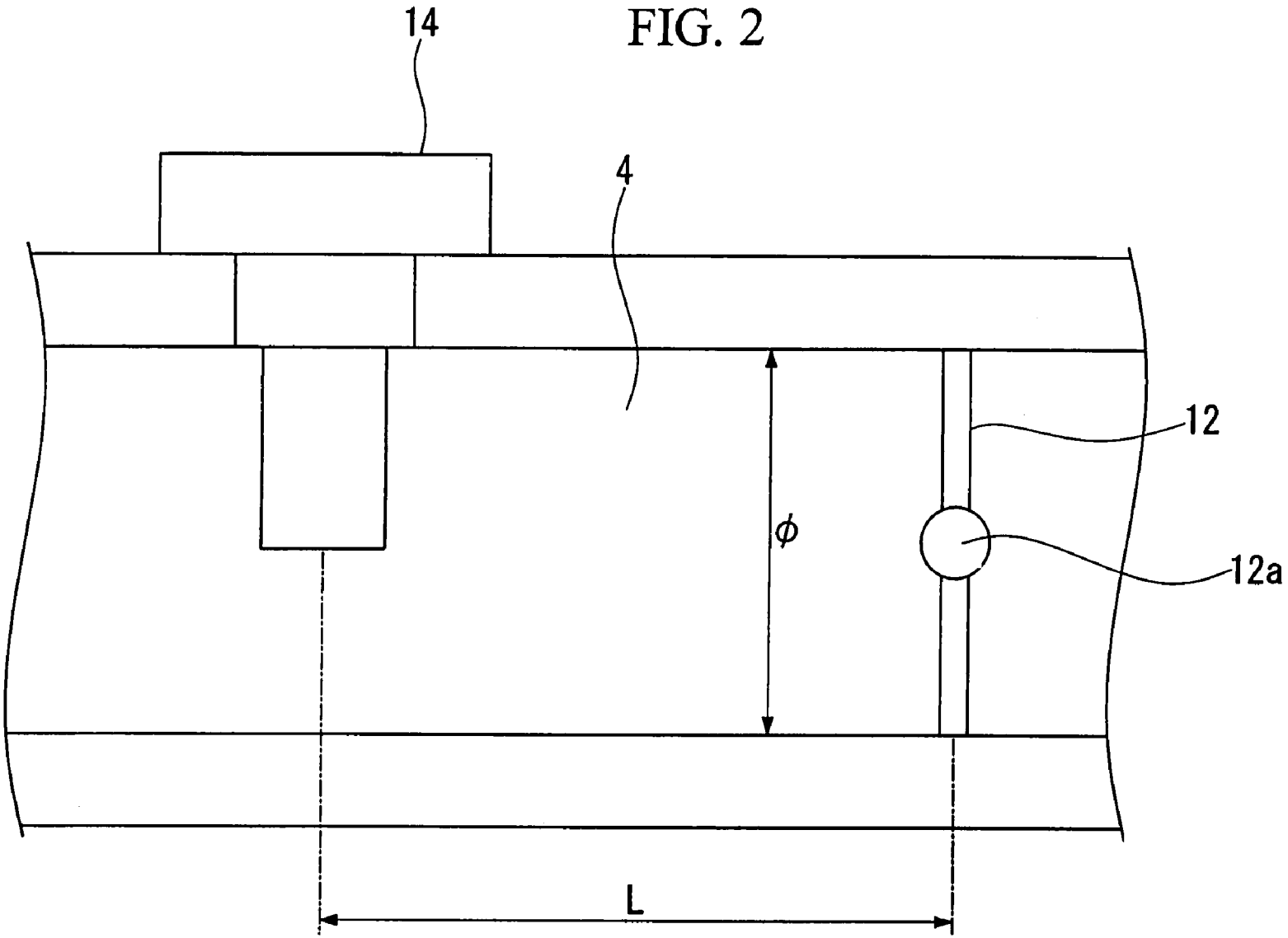
FIG. 2 is a diagram for explanation of an installation position of an air flow meter.

A first embodiment of this invention will be explained in detail with reference to the drawings. FIG. 1 is a schematic diagram of a control system for internal combustion engine according to an embodiment of this invention. FIG. 2 is a diagram for explanation of an installation position of an air flow meter.

An engine control system 1 of the embodiment shown in FIG. 1 sucks in air from an air intake passage 4 which is connected to an intake manifold 3 of an engine 2, being an internal combustion engine, mixes this air with fuel which is injected from an injector 5 fitted to the intake manifold 3, and causes it to combust inside a combustion chamber 2*a* of the engine 2. When discharging the combustion gas through an exhaust manifold 6 after combustion, a control device 7 controls the amount of fuel injected in accordance with the air flow measured by an air flow meter 14, being a sensor installed at a predetermined position in the air intake passage 4.

The air intake passage 4 includes an air cleaner 11, and a throttle body 13 which is fitted with a throttle valve 12 for adjusting the amount of air, the throttle body 13 being provided downstream from the air cleaner 11. The air flow meter 14 is attached to the throttle body 13, and measures the amount of air sucked into the engine 2 along the air intake passage 4 as mass flow. The air flow meter 14 shown in FIG. 2 is positioned at a distance L downstream from a pivot shaft 12*a* of the throttle valve 12, and is able to measure the amount of air which is actually sucked into the combustion chamber 2*a* of the engine 2 by using a measuring section 14*a* which is exposed in the air intake passage 4. Incidentally, the number of man-hours required for setting can be reduced by attaching the air flow meter 14 to the throttle body 13.

One example of the air flow meter 14 suitable for this embodiment is a sensor which includes the measuring section 14*a* made by disposition of a platinum thin-film on a silicon substrate, and applies a current such that the temperature of the platinum thin-film is kept constant. If the mass of air flowing around the platinum thin-film increases, the amount of heat dissipated from platinum thin-film through the air also increases, while the temperature of the platinum thin-film drops proportionally. At this time, the air flow meter 14 increases the current flowing through the platinum thin-film so as to keep the temperature constant. On the other hand, when the amount of conduction in the air decreases, since the heat dissipation decreases and the temperature of the platinum thin-film increases, the air flow meter 14 reduces the current flowing through the platinum thin-film accordingly. Since the current value increases/decreases in proportion to the increase/decrease in the mass of air flowing around the platinum thin-film, the amount of air can be measured by monitoring this current value. This type of air flow meter 14 can reduce the heat capacity more than when using a platinum wire, and consequently has high responsiveness and high measuring precision.

The injector 5 shown in FIG. 1 injects fuel into the air flowing through the intake manifold 3 by opening and closing the electromagnetic injection valve, whereby fuel is scooped from a fuel pump 16 inside a fuel tank 15 and regulated by a regulator before being supplied.

Mixed gas is supplied to the combustion chamber 2*a* and discharged therefrom after combustion by an inlet valve 2*b* and an outlet valve 2*c*, which are driven by an unillustrated bubble timing mechanism.

The mixed gas is ignited by an ignition plug 8. The ignition plug 8 discharges using high energy stored in an ignition circuit 9.

The control device 7 which implements control in this engine control system 1 is also termed an electronic control unit (ECU). The control device 7 includes a central processing unit (CPU) or a read only memory (ROM) and the like, and is driven by power supplied from a battery 10. The control device 7 receives the output current of the air flow meter 14 as input data, executes predetermined processing thereto, determines the amount of fuel supplied to the injector 5 from the fuel pump 15, the injection amount of the injector 5 and an injection timing, and a timing of starting recharging to the ignition circuit 9, and an ignition timing, and outputs command signals to the respective units.

Here, the control device 7 includes an air amount calculation device which calculates the amount of air by multiplying the output current of the air flow meter 14 by a predetermined coefficient, a determination device which determines the rise of suction and the fall of suction from changes in the air amount, an integration device which integrates the air amount from the start of suction, and an injection amount control device which controls the injector 5 and the like. The control device 7 executes control to discharge the ignition plug 8 at a predetermined timing and combust a mixed gas of air and fuel, and for that purpose includes an ignition control device which calculates and controls the charge time of the ignition circuit 9 in accordance with the intake air amount and the fuel amount. The control device 7 may have a configuration which does not control ignition. In this case, another control device is provided and functions as an ignition control device.

Figure 3:
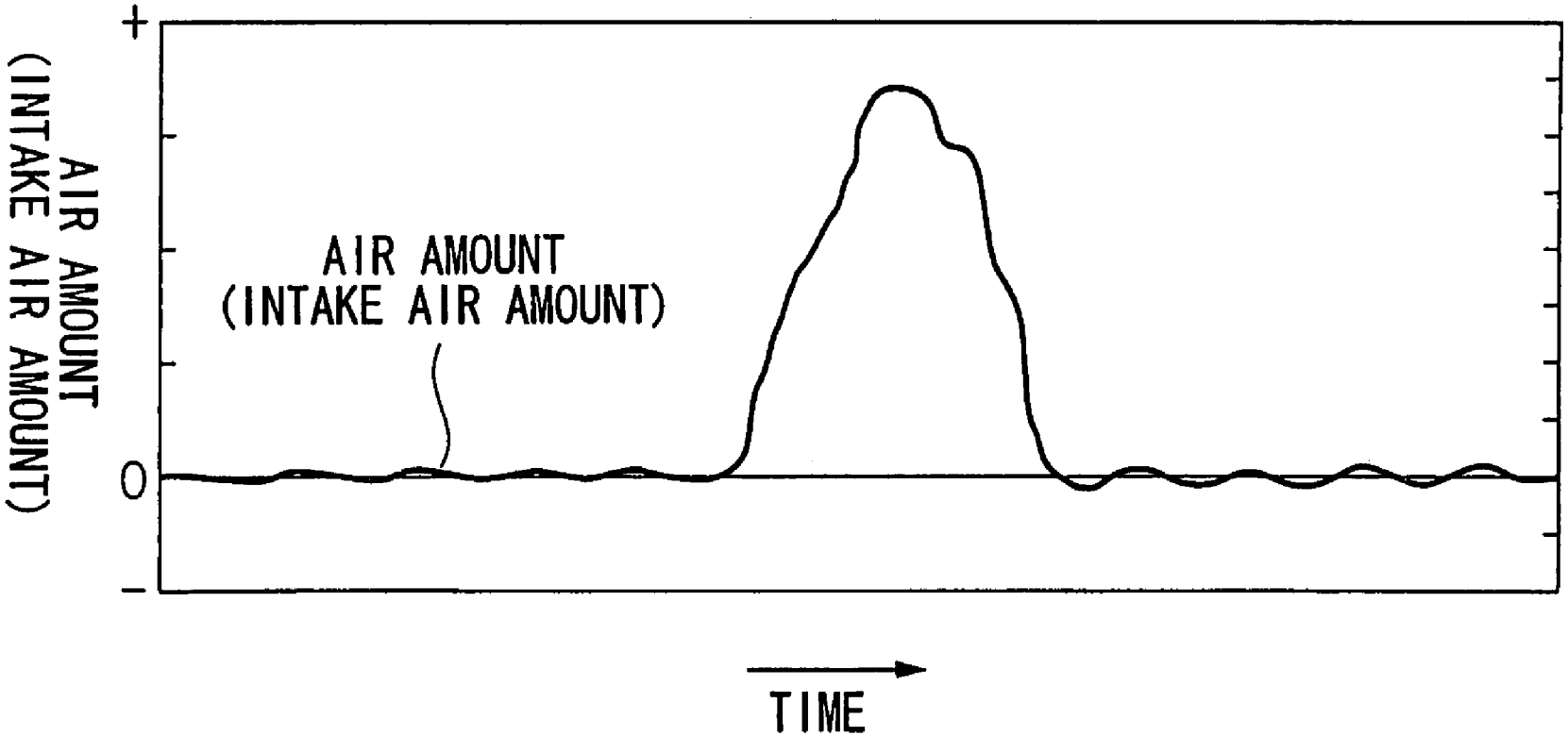
FIG. 3 is a diagram of changes in an air amount which changes in accompaniment with the operation of an engine.

The data processed by the control device 7 and the processing itself will be explained using FIG. 1 and FIG. 3. FIG. 3 is a diagram of changes in the air amount which changes in accompaniment with operation of an engine, the horizontal axis representing elapsed time and the vertical axis representing the intake air amount. In FIG. 3, the air amount which fluctuates as time elapses is a value calculated by multiplying the current output from the air flow meter 14 by a predetermined coefficient. The air amount thus calculateed is treated as front-flow when it is greater than a predetermined threshold (reference value), and as back-flow when it is below this threshold. Here, 'front-flow' is air which flows in the direction of being sucked into the engine 2. 'Back-flow' is air which flows in the opposite direction, i.e. the direction of the throttle valve 12, and is caused when the inlet valve 2*b* of the engine 2 is closed and the trapped air flows in the opposite direction. A state where front-flow and back-flow are generated alternately is termed 'pulsating flow'.

There are times when the inlet valve 2*b* of the engine 2 opens while the throttle valve 12 is slightly open, generating negative pressure inside the air intake passage 4. This negative pressure remains even after the inlet valve 2*b* is closed, and may cause a small flow of air entering through the throttle valve 12. The flow of air generated under such conditions is termed 'insufficient flow'.

The region where the air amount is increasing beyond the range of pulsating flow and insufficient flow is the region where air is being sucked into the engine 2, and corresponds to the suction stroke of the engine 2. The start of suction (rise of suction) is deemed to be the point at which the air amount exceeds the size of the pulsating flow and the insufficient flow and rises from zero. Since the start of suction is determined by the timing at which the inlet valve 2*b* opens (a predetermined angle of the crank shaft 2*d*) irrespective of the number of rotations of the engine 2, it is possible to control the timing of fuel injection and the ignition timing by taking this point as a reference.

The end of suction (fall of suction) is the point where the air amount, which has peaked and is decreasing, drops to zero.

The attachment position of the air flow meter 14 and its relationship with the pros and cons of measuring the rise of suction will be explained with reference to FIG. 4 and FIG. 5.

Figure 4:
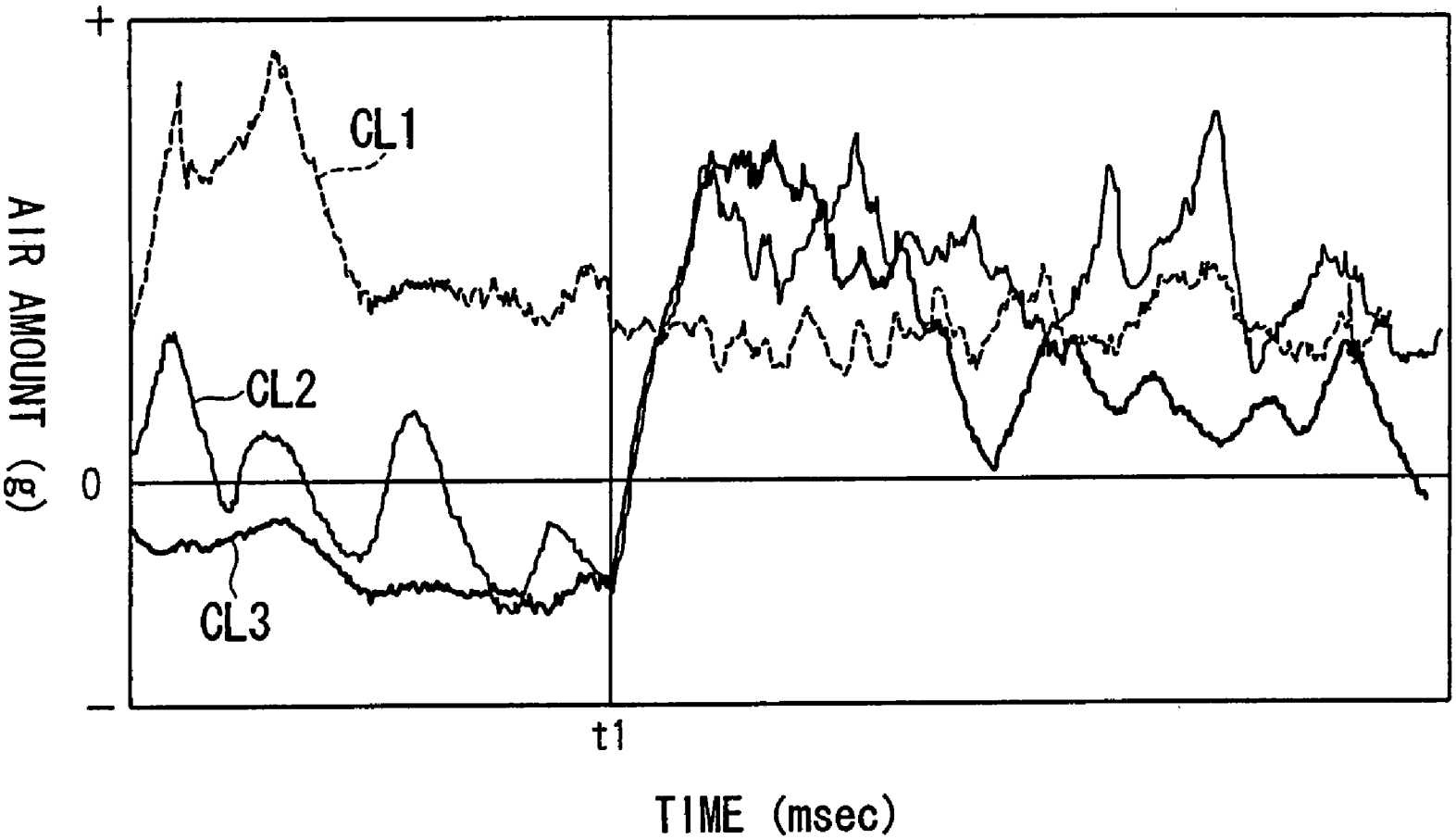
FIG. 4 is a diagram of changes in the air amount for each installation position of an air flow meter.
Figure 5:
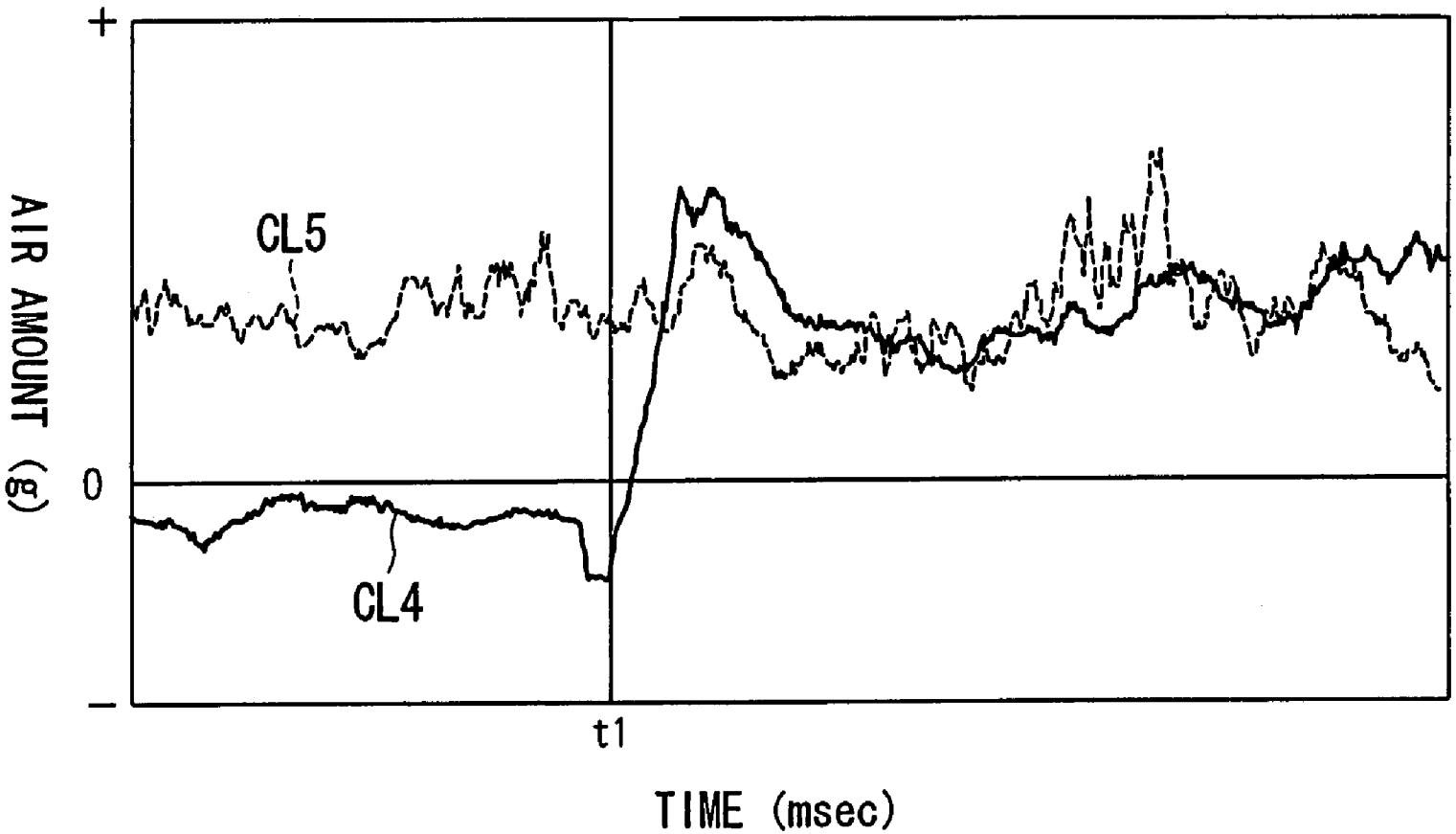
FIG. 5 is a diagram of changes in the air amount for each installation position of an air flow meter.

FIGS. 4 and 5 show results of an investigation of changes in the air amount at an installation distance L (see FIG. 2) from the pivot shaft 12*a* of the throttle valve 12 when a throttle body 13 is used in the air intake passage 4 having a diameter of 22 mm and the engine 2 rotates 1500 times per minute. The horizontal axes represent elapsed time, and the vertical axes represent the air amount measured by the air flow meter 14. The link CL1 in FIG. 4 represents change in the air amount when the installation distance L is 22 mm. The line CL2 represents change in the air amount when the installation distance L is 44 mm, and the line CL3 represents change in the air amount when the insufficient flow is 66 mm. The line CL4 of FIG. 5 represents change in the air amount when the installation distance L is 88 mm, and the line CL5 represents change in the air amount when the installation distance L is 110 mm. The time t1 is the timing for starting suction by opening the inlet valve 2*b*.

As shown by the line CL1 in FIG. 4, when the air flow meter 14 is provided at an installation distance L of 22 mm, a large air amount is measured from the beginning and the rise of suction cannot be confirmed at time t1. At the installation distance L of 44 mm shown by the line CL2, a small air amount is firstly measured as a pulsating flow and an insufficient flow, rises precipitously near the time t1, and thereafter a large air amount is maintained. At the installation distance L of 66 mm shown by the line CL3, the air amount rises precipitously near time t1 and thereafter pulsates while gently decreasing. While the change in the air amount at the installation distances L of 44 mm and 66 mm also differs according to the capacity of the engine 2, it is greater than 0.00015 g. This is a sufficient change in the air amount to identify a pulsating flow, an insufficient flow, and the rise of suction.

When the air flow meter 14 is provided at an installation distance L of 88 mm as shown by the line CL4 in FIG. 5, it can be seen that the air amount rises precipitously near time t1. Here too, the change in the air amount is greater than 0.00015 g. In contrast, at the installation distance L of 93 mm as shown by the line CL5, a large air amount is measured irrespective of the time, and the air amount near time t1 has neither pulsating flow or insufficient flow zones.

To identify the start of suction from the results measured by the air flow meter 14, a large change in the air amount (e.g. more than 0.0001 g) is needed within a short period of time. Therefore, the ideal installation position for the air flow meter 14 which can confirm the rise of suction in this embodiment is within the range of more than 44 mm and less than 88 mm from the position where the throttle valve 12 is attached. If the installation distance L is less than 44 mm, problems are caused by disruption of the air stream when the path is throttled by the throttle valve 12, and when the installation distance L exceeds 88 mm, the rise of suction cannot be determined due to disruption of the air stream. A more ideal installation distance L is between 44 mm and 66 mm, which is around the start of suction and has a greatly changing air amount.

The ideal installation distance L of the air flow meter 14 can be expressed using the diameter $\phi$ of the air intake passage 4 where the air flow meter 14 is attached as $L=k\times\phi$. Here, k is a predetermined coefficient having a value between 2 and 4. The diameter $\phi$ is the average diameter of the air intake passage 4 in the region from the throttle valve 12 to the air flow meter 14. The diameter $\phi$ indicates tendencies not only of the 22-mm diameter of the throttle body 13 but also similar tendencies of other diameters used in the engine 2. The installation distance L and the diameter $\phi$ have a proportional relationship due to the fact that, although the air stream in the rear-stage of the throttle valve 12 is liable to become disrupted when the diameter $\phi$ is large, the air stream thereafter continues to be stable for a long time.

Subsequently, an operation executed by the control device 7 as interrupt processing in each fixed cycle after the engine 2 starts operating will be explained. Here, the installation distance L of the air flow meter 14 is twice to four times the diameter of the air intake passage 4.

Firstly, the air flow meter 14 measures the mass flow of air flowing along the air intake passage 4 at an installation distance L from the pivot shaft 12*a* of the throttle valve 12 on the downstream side thereof, and the control device 7 calculates an air amount based on this. When the inlet valve 2*b* of the engine 2 is closed, the air amount flowing is small, and so the control device 7 determines that the engine 2 is not executing a suction stroke.

On the other hand, when the suction stroke of the engine 2 starts and the inlet valve 2*b* opens, the air in the air intake passage 4 is sucked into the combustion chamber 2*a* and the amount of air flowing the air intake passage 4 increases precipitously. The air flow meter 14 measures the increasing mass flow of the air and outputs a signal to the control device 7. The control device 7 determines the change in the calculated air amount and, if it satisfies conditions for an amount of change of a predetermined rise (e.g. an increase of 0.00015 g within a predetermined period of time), the control device 7 determines that suction has started from the start of that rise, and calculates the total air amount from that point as the suction amount. The suction amount is used in calculating the injection amount of fuel to be injected from the injector 5. The injection amount is calculated by dividing the suction amount by a predetermined air-fuel ratio. The control device 7 outputs a signal corresponding to the calculated injection amount to the injector 5, which injects fuel into the air which makes suck the required amount of fuel.

As the suction stroke ends and the inlet valve 2*b* starts to close, the amount of air flowing in the air intake passage 4 decreases. The air flow meter 14, which is installed at a distance of twice to four times the diameter of the air intake passage 4, can measure the decrease in the mass flow which accompanies this decrease in the air amount. Accordingly, when the calculated air amount falls below a predetermined value, the control device 7 determines that suction has ended and stops the injection of fuel. Since the fuel is injected into the sucked air from the start of suction until the end of suction, the air and the fuel can be efficiently mixed.

Thus, by providing the air flow meter 14 at a installation distance L downstream from the throttle valve 12, it becomes possible to determine the start and end of the suction stroke from changes in the air amount measured by the air flow meter 14. In the case of a single-cylinder engine 2, the suction timing can be measured without providing other sensors for measuring the rotation angles of the crank shaft 2*d* and the cam. Since the rise and fall of suction can be determined, the amount of air which is sucked during the suction stroke can be precisely measured. In the case of a multi-cylinder engine 2, the air flow meter 14 can be used in combination with other sensors for measuring the rotation angles of the crank shaft 2*d* and the cam, making it possible to measure the amount of air sucked and the suction timing for each cylinder.

While the suction rise is used as a reference point for measuring the air amount used in calculating the fuel injection amount and as a reference point for the start of fuel injection, it can also be used as a reference point for the ignition timing in the engine 2. This is due to the fact that, while the ignition timing is determined beforehand as the angle of rotation of the crank shaft 2*d*, this angle of rotation can be determined from the time which elapses from the start of suction. Therefore, the mixed gas in the combustion chamber 2*a* should be ignited after a predetermined time has elapsed from the start of suction. Furthermore, the control device 7 may determine the number of rotations of the engine 2 by counting the generated cycles of the rise of suction, and adjust the time from the start of suction to ignition in accordance with the number of rotations of the engine 2.

INDUSTRIAL APPLICABILITY

The present invention relates to a control system for internal combustion engine having a throttle valve inside an air intake passage, and includes a sensor which is installed downstream from the throttle valve and measures the amount of air sucked by the internal combustion engine, a control device which calculates the amount of fuel to be injected based on the air amount measured by the sensor; and an injector for fuel injection which injects fuel corresponding to the injection amount calculated by the control device. The distance between the installation position of the throttle valve and the installation position of the sensor is set at twice to four times the diameter of the air intake passage.

In the control system for internal combustion engine of this invention, the distance between the installation position of the throttle valve and the installation position of the sensor should preferably be between 44 mm and 66 mm.

According to the control system for internal combustion engine of this invention, the start of suction can be determined from change in the air amount. Therefore, the amount of air sucked by the internal combustion engine can be accurately measured with a simple constitution, and the fuel injection amount can be determined by calculation based on the air amount measured. Since the timing of fuel injection takes the start of suction as a reference, fuel can be injected into air which is being sucked.

Furthermore, according to the control system for internal combustion engine of this invention, since large air amount change can be measured at the start of suction, the start of suction can be determined with high precision.

The invention claimed is:

1. A control system for internal combustion engine having a throttle valve in an air intake passage, comprising:

a sensor which is installed downstream from the throttle valve and measures an amount of air sucked by the internal combustion engine;

a control device which calculates an injection amount of fuel based on the amount of air measured by the sensor; and an injector for fuel injection which injects fuel corresponding to the injection amount calculated by the control device, wherein a distance between an installation position of the throttle valve and an installation position of the sensor is twice to four times a diameter of the air intake passage.

2. A control system for internal combustion engine according to claim 1, wherein the distance between the installation position of the throttle valve and the installation position of the sensor is between 44 mm and 66 mm.

* * * * *